United States Patent [19]

Murray

[11] 4,184,677

[45] Jan. 22, 1980

[54] LENGTH AND WIDTH-ADJUSTABLE JUMP-ROPE-EXERCISING APPARATUS

[76] Inventor: James E. Murray, 1700 S. 4th St., Alhambra, Calif. 91803

[21] Appl. No.: 908,966

[22] Filed: May 24, 1978

[51] Int. Cl.[2] ..... A63B 5/20

[52] U.S. Cl. ..... 272/74

[58] Field of Search ..... 272/74, 75, 61, 70.3, 272/70.4; 35/29 R; 223/63

[56] References Cited

U.S. PATENT DOCUMENTS

| | | | |
|---|---|---|---|
| 169,625 | 11/1875 | Crandall | 272/74 |
| 950,100 | 2/1910 | Gough | 272/61 UX |
| 1,315,097 | 9/1919 | Denney | 272/70.4 |
| 2,278,901 | 4/1942 | Smock | 272/70.4 |
| 2,995,370 | 8/1961 | Deskins | 272/74 |
| 3,072,402 | 1/1963 | McCombs | 272/74 |
| 3,118,666 | 1/1964 | Fitch | 272/75 |
| 3,182,999 | 5/1965 | Updaw | 272/74 |
| 3,493,229 | 2/1970 | Ramsey | 272/74 |

*Primary Examiner*—Richard C. Pinkham
*Assistant Examiner*—Arnold W. Kramer
*Attorney, Agent, or Firm*—Francis X. Lo Jacono

[57] ABSTRACT

A size-adjustable jump-rope exercising apparatus comprising a framework structure having a substantially "H"-shaped configuration wherein the framework is formed having spaced, parallel, longitudinally extended, side-frame members. The frame members are connected together intermediate their free ends by a transverse strut member by which the width of the apparatus can be adjusted and which includes gripping handles whereby the user thereof holds the apparatus for rotation about the longitudinal axis of the strut member when the strut member is positioned in a horizontal mode. Mounted at each free end of the side member is an elongated rod member adjustably mounted longitudinally therein and a flexible rope which is looped across from the outer end of one rod member to the other, defining a closed-loop, jump structure having dual jumping ends.

1 Claim, 6 Drawing Figures

FIG. 1
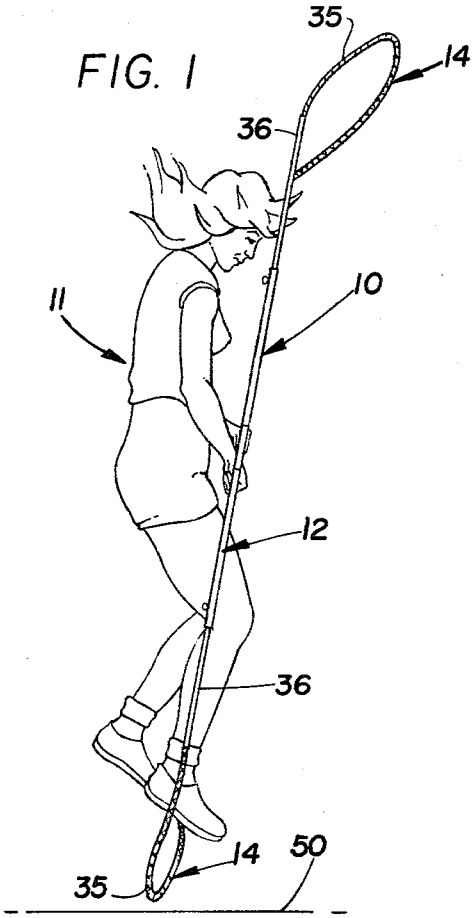
FIG. 2
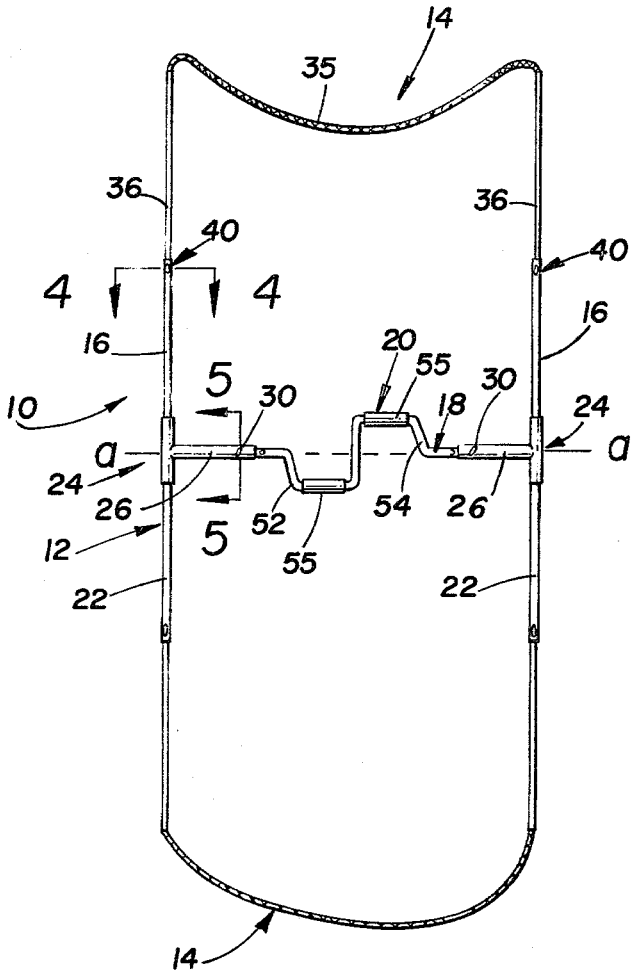
FIG. 3
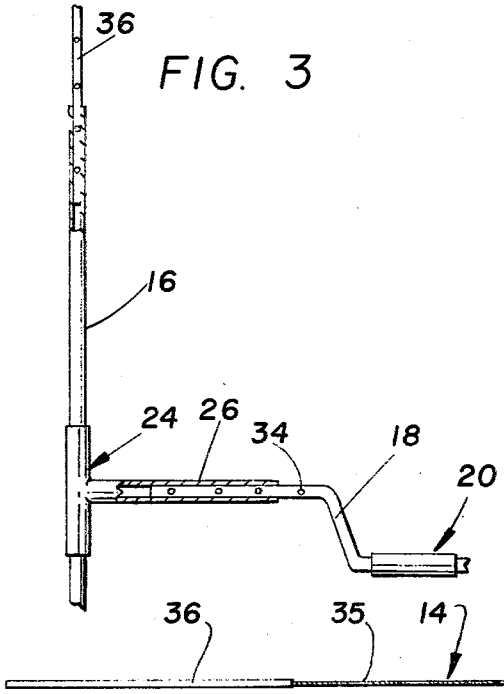
FIG. 4
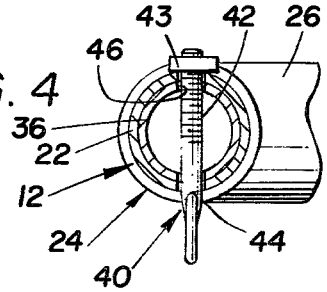
FIG. 5
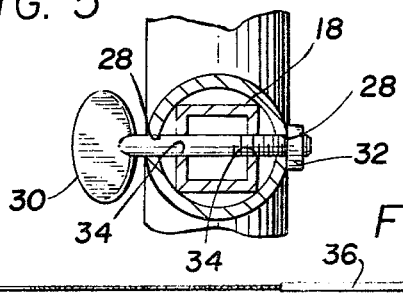
FIG. 6

LENGTH AND WIDTH-ADJUSTABLE JUMP-ROPE-EXERCISING APPARATUS

BACKGROUND OF THE INVENTION

1. Field of the Invention

This invention relates to an exercising device, and more particularly to a jump-rope apparatus that allows the rope to rotate faster than normal and aid in exercising other parts of the body in addition to the legs.

2. Description of the Prior Art

As is well known in the art, various types of jump-rope exercisers are presently being used, one being the typical jump rope that comprises an elongated section of rope having handles attached to each free end, so that the user can hold the rope and then rotate it about his body while jumping off the surface of the ground, allowing the turning rope to pass under the feet. The rope handles of this type of jump rope are generally actuated by the individual's wrist movement only, and does not provide the proper exercising of the arms and shoulders as does the present invention. As an example of other types of jumping devices, one may refer to U.S. Pat. No. 3,466,032 wherein a jumping hoop is formed from a pair of metal rods which are adjustable relative to each other, so as to accommodate children or persons of different sizes, one of the metal rods being selectively adjustable relative to the other; and each rod is formed as interconnected, "U"-shaped member wherein no flexible rope is used.

To the applicant's knowledge, no jumping device as herein disclosed provides a more complete exercising means—for young and old alike—which includes a dual-jump-rope end.

SUMMARY OF THE INVENTION

The present invention comprises a unique apparatus for jumping that includes a frame structure having a pair of juxtaposed, side-frame members that are interconnected to each other by a lateral strut member adjustably secured between each side member, whereby the side members are held in parallel relationship to each other, causing them to turn together about the central, longitudinal axis of the strut member.

The strut member is provided with a pair of gripping or crank handles, one being offset from the other, to allow the frame structure to rotate with the jump rope mounted thereto about the body of the user, with the user jumping over the rope as it passes over the ground surface. This device includes two jump-rope members adjustably secured to the respective free ends of the side-frame members, wherein the rope is looped from one side member to the other. Thus, as the frame structure is rotated, the user must jump twice for every 360° of rotation; and therefore, the jumping exercise is doubled in intensity in comparison with the normally known jumping devices.

OBJECTS AND ADVANTAGES OF THE INVENTION

The present invention has for an important object a provision wherein the rate of jumping by the user is doubled over existing devices; and wherein other body areas are utilized and exercised, in addition to the leg members.

It is another object of the invention to provide a jump-rope exercising apparatus that includes a fixed frame structure having an "H"-shaped configuration, allowing the user to be positioned between the side-frame members and within a closed jumping loop formed by a pair of oppositely arranged jump-rope members.

It is a further object of the invention to provide a rotary-frame-structure apparatus for jumping that allows for various adjustments to its structural size, so as to be readily adapted for use by children and adults of different sizes.

It is still another object of the invention to provide an apparatus of this type that is relatively inexpensive to manufacture.

It is still a further object of the invention to provide a device of this character that is simple and rugged in construction.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements or modes of operation that are properly within the scope of the appended claims.

DESCRIPTION OF THE DRAWINGS

Referring more particularly to the accompanying drawings, which are for illustrative purposes only:

FIG. 1 is a pictorial view, showing the present apparatus as it is normally used with the user jumping over the rope passing over the surface of the ground;

FIG. 2 is an elevational view of the apparatus;

FIG. 3 is an enlarged view of a portion of the frame structure, showing the various adjusting elements thereon;

FIG. 4 is an enlarged, cross-sectional view taken substantially along line 4—4 of FIG. 2;

FIG. 5 is also an enlarged cross-sectional view of the adjustable connection between the side member and the strut member, the section being taken along line 5—5 of FIG. 2; and FIG. 6 is a plan view of the jump-rope member.

DESCRIPTION OF THE PREFERRED EMBODIMENT

Referring more particularly to the accompanying drawings, there is shown a rope-jumping apparatus, generally indicated at 10. This jumping apparatus provides a simple means by which an individual, as so indicated at 11, can exercise at his or her own pace.

The present invention comprises a framework structure, designated at 12, having a generally "H"-shaped configuration wherein rope means 14 are mounted at each opposing open end of the "H" framework, thus defining a closed-loop apparatus for jumping, as seen in FIGS. 1 and 2.

Framework structure 12 comprises a pair of elongated, side-frame members 16, the side-frame members being adjustably secured in parallel relationship to each other by a traversing, cross-strut member 18. The cross-strut member also helps to define a rotating means, designated at 20.

It should be noted at this time that the framework structure may be formed from light metal, such as aluminum, or from any suitable plastic material. Hence, the shapes as shown can also be varied but are shown herein as to provide a working example of the present apparatus.

Accordingly, the side-frame members comprise an elongated, tubular, bar member 22 having a substantially "T"-shaped fitting 24 affixed thereto intermediate the ends of the tubular bar 22.

It should be noted that the lateral extending member 26 of fitting 24 can be affixed directly to the side member by welding or other suitable means.

Member 26 is sufficiently long in order to adjustably receive the terminal ends of strut member 18. Therefore, adjustable means are provided wherein the side-frame members can be spaced apart at a distance, depending upon the size of the individual user 11. Thus, the adjustable means comprises a pair of holes 28 oppositely disposed in lateral member 26, in which a wing bolt 30 is passed therethrough and secured by nut 32. As shown in FIGS. 3 and 5, strut member 18 is formed having a square shape, and is inserted in lateral member 26, wherein the end of strut 18 is provided with a plurality of alignment holes 34. Hence, as seen in FIG. 5, bolt 30 also passes through strut holes 34, thus securing the side frames 16 in a predetermined, spaced-apart relationship to each other.

Rope means 14 comprises a flexible rope member 35 having tubular connection rods 36 adjustably mounted to the free ends thereof. Rods 36 have a smaller diameter than tubular frame member 16 in which the rods 36 are slidably received.

A locking means 40 is provided adjacent each distal end of each tubular bar 22. In this arrangement, as seen in FIG. 4, a wing bolt 42 is passed through aligned holes 44 and 46 formed in bar 22 and rod 36, respectively. However, various means can be used in placing of the wing bolt 42 and nut 43. As an example, set screws may be used in place thereof.

Thus, it can be seen that rope 35, together with its associated rods, form a closed-loop, jumping unit, wherein the loops can be adjusted inwardly or outwardly to accommodate for the height of the individual user 11.

As shown in FIG. 1, it can be seen that the user must jump over rope 35 as it passes over the ground surface 50. Due to the dual arrangement of the jumping rope 35 of the apparatus, the user jumps twice for every 360° rotation of the framework.

To provide ease of rotating the framework, the rotating means is formed as part of the transverse strut member 18, wherein the rotating means comprises the transverse strut member 18 having offset gripping members or cranks 52 and 54. Each gripping member or crank includes rotatable sleeves 55 which are gripped by the user. Thus, by moving gripping members 52 and 54 in a circular motion about the longitudinal axis a—a of strut 18, the side-frame members 16 rotate, causing the ropes 35 to flex outwardly as seen in FIG. 1.

The invention and its attendant advantages will be understood from the foregoing description; and it will be apparent that various changes may be made in the form, construction and arrangement of the parts of the invention without departing from the spirit and scope thereof or sacrificing its material advantages, the arrangement hereinbefore described being merely by way of example; and I do not wish to be restricted to the specific form shown or uses mentioned, except as defined in the accompanying claims.

I claim:

1. A jump-rope-exercising apparatus comprising:

a framework including a pair of parallel, spaced-apart, side-frame members having oppositely disposed free ends;

a transverse strut member adjustably interconnecting each side-frame member, said strut member disposed intermediate the free ends of said side-frame members, thereby providing a substantially "H"-shaped-framework configuration, wherein each said side-frame member includes a "T"-shaped fitting adapted to receive a respective of said transverse strut member therein;

a pair of flexible rope members connected across from one side member to the other side member, wherein said rope members include elongated rod members fixedly attached to each end of said rope members, and arranged to be adjustably mounted longitudinally within said free ends of said side-frame members, said rod members being provided with a plurality of aligned adjusting holes to align with holes disposed in said free ends of said side-frame members, wherein a bolt is adapted to be received therethrough, thereby providing a locking means to adjustably lock said rope members in place thereon;

means for adjusting the space relationship between said parallel side members to accommodate for the size of the user thereof, said means comprising a pair of aligned holes disposed in said fittings, a plurality of aligning holes being formed in each end of said strut member, and arranged to be aligned with the holes in said fittings, and a bolt and a nut positioned to secure said strut to said fittings; and means for rotating said framework about the longitudinal axis of said strut member wherein said rotating means comprises a pair of offset crank handles formed on said transverse strut member.

* * * * *